US006335309B1

(12) United States Patent
Takagi et al.

(10) Patent No.: US 6,335,309 B1
(45) Date of Patent: Jan. 1, 2002

(54) DIE RELEASE LUBRICANT

(75) Inventors: Hiromi Takagi; Tomoyuki Hatano, both of Nagoya; Tadao Okura, Otsu, all of (JP)

(73) Assignees: Denso Corporation, Aichi-pref; Nippon Graphite Industries Co., Ltd., Shiga-ken, both of (JP)

( * ) Notice: Subject to any disclaimer, the term of this patent is extended or adjusted under 35 U.S.C. 154(b) by 0 days.

(21) Appl. No.: 09/357,129

(22) Filed: Jul. 20, 1999

(30) Foreign Application Priority Data

Jul. 21, 1998 (JP) ..... 10-204880

(51) Int. Cl.[7] ..... C10M 125/00

(52) U.S. Cl. ..... 508/115; 508/116; 508/126; 508/128; 508/130; 508/155; 508/181

(58) Field of Search ..... 508/115, 116, 508/126, 128, 130, 155, 181; 72/42

(56) References Cited

U.S. PATENT DOCUMENTS 4,104,178 A * 8/1978 Jain et al. ..... 508/115
4,287,073 A * 9/1981 Jain et al. ..... 508/115
5,093,076 A * 3/1992 Young et al. ..... 419/12
5,584,201 A * 12/1996 Graham et al. ..... 72/42
5,662,156 A * 9/1997 Freeman ..... 164/61

FOREIGN PATENT DOCUMENTS

| | | |
|---|---|---|
| JP | 56-125498 | 10/1981 |
| JP | 02120397 | * 5/1990 |
| JP | 4-279244 | 10/1992 |

* cited by examiner

*Primary Examiner*—Jacqueline V. Howard
(74) *Attorney, Agent, or Firm*—Pillsbury Winthrop LLP

(57) ABSTRACT

Die release lubricant is made from powder solid lubricant, adhesion enhancer made of organic or inorganic compound and volatile solvent. Before melted metal is injected into a die for casting, the die release lubricant is sprayed to an inside surface of the die. The die release lubricant is in a liquid state and is uniformly applied to the inside surface of the die. As a result, application efficiency of the die release lubricant is improved while an amount of thermal decomposition gas generated during casting is reduced.

13 Claims, 2 Drawing Sheets

DIE RELEASE LUBRICANT

CROSS REFERENCE TO RELATED APPLICATION

This application relates to and claims priority from Japanese Patent Application No. 10-204880 filed on Jul. 21, 1998, the contents of which are hereby incorporated by reference.

BACKGROUND OF THE INVENTION

1. Field of the Invention

The present invention relates to die release lubricant applied to an inside surface of a die for casting of metal such as aluminum.

2. Related Art

Conventionally, when metal such as aluminum is casted with a die (i.e., metal die), die release agent and lubricant are applied to an inside surface of the die so that molded metal is smoothly released from the die and a plunger for pushing melted metal into the die smoothly moves.

However, the conventional die release agent and lubricant are substantially composed of oil or water soluble fat and oil. Therefore, the conventional die release agent and lubricant applied to the die are decomposed due to heat of melted metal and the die during casting, and generate a relatively large amount of thermal decomposition gas. The generated thermal decomposition gas may be taken into the molded metal and cause various defects such as a shrinkage cavity and wrinkling. As a result, quality of the molded metal is declined.

Some of the conventional die release agent and lubricant include an inorganic compound dispersed into water. However, in this case, since water is not dried quickly, water is decomposed (evaporated) due to heat of the melted metal during casting. As a result, the above-mentioned defects of the molded metal occur.

JP-A-4-279244 discloses powder die release agent made by mixing powder or granule die release base material composed of an inorganic compound and another organic or inorganic compound. In the powder die release agent, both the die release base material and the organic/inorganic compound are made into powder or granule, or the die release base material is covered by the organic/inorganic compound.

However, when the powder die release agent is applied to an inside surface of a die, the powder die release agent tends to be scattered due to air flowing around the die. As a result, application efficiency and a working environment are worsened. Further, the powder die release agent has poor dispersibility and may be ununiformly applied to the surface of the die.

An application amount of the powder die release agent may be increased so that the powder die release agent is uniformly applied to the surface of the die. However, in this case, an amount of thermal decomposition gas generated from the powder die release agent during casting is also increased. As a result, the molded metal may have defects such as the shrinkage cavity and wrinkling, and quality of the molded metal is declined.

SUMMARY OF THE INVENTION

In view of the foregoing problems, it is an object of the present invention to provide die release lubricant which is uniformly applied to an inside surface of a die and generates an extremely little amount of thermal decomposition gas while improving application efficiency.

According to the present invention, die release lubricant includes powder solid lubricant, adhesion enhancer made of organic or inorganic compound and volatile solvent. The die release lubricant is applied to an inside surface of a die before melted metal is injected into the die for casting. The die release lubricant is in a liquid state and is uniformly applied to the inside surface of the die. Therefore, an application amount of the die release lubricant is reduced, thereby reducing thermal decomposition gas generated from the die release lubricant during casting. As a result, the molded metal has almost no defects such as a shrinkage cavity and wrinkling and has excellent quality. Furthermore, the die release lubricant is less scattered during application in comparison with conventional powder die release agent. As a result, application efficiency and a working environment are improved.

Preferably, the powder solid lubricant has an average particle radius of 0.1–10 $\mu$m, and includes particles having a radius of smaller than 0.1 $\mu$m at less than 5% by weight, and particles having a radius of larger than 10 $\mu$m at less than 5% by weight. As a result, application uniformity of the die release lubricant is improved.

More preferably, a weight ratio of the adhesion enhancer to the powder solid lubricant is in a range of 0.05/100 and 15/100. As a result, adhesion strength of the die release lubricant is increased.

More preferably, the volatile solvent has a boiling point of 40–150° C. and a firing point of 250° C. or higher. As a result, the volatile solvent is immediately volatized when the die release agent is applied to the die, and the powder solid lubricant is quickly and firmly adhered to the die with the adhesion enhancer.

BRIEF DESCRIPTION OF THE DRAWINGS

This and other objects and features of the present invention will become more readily apparent from a better understanding of the preferred embodiment described below with reference to the accompanying drawings, in which.

DETAILED DESCRIPTION OF THE PREFERRED EMBODIMENT

A preferred embodiment of the present invention is described hereinafter with reference to the accompanying drawings.

Die release lubricant according to a preferred embodiment of the present invention is prepared and is sprayed to a surface of a die member corresponding to an inside surface of a die. An amount of thermal discomposition gas generated from the die release lubricant during casting is measured. Further, the die release lubricant is applied to an inside surface of a die, and releasability of the die release lubricant for releasing molded metal from the die is measured. The both measurements are also conducted against a conventional die release agent as a comparison.

A method of the above-mentioned measurements will be described. First, the die release lubricant according to the embodiment is prepared by mixing graphite as powder solid lubricant at 2% by weight, hydrocarbon resin as adhesion enhancer at 0.2% by weight and alternate-chlorofluorocarbon group solvent as volatile solvent at 97.8% by weight. The powder solid lubricant has an average particle radius of 2 $\mu$m, and includes particles having a radius smaller than 0.1 $\mu$m at 0.5% by weight, and particles having a radius larger than 10 $\mu$m at 1% by weight. Next, the die release lubricant is sprayed to a plate tool steel (i.e., die member) heated at 250° C. through a spray nozzle. Then, air is blown toward the plate tool steel for 10 seconds, and the plate tool steel is left for 30 seconds at a room temperature. Thereafter, the plate tool steel is placed in a vacuum chamber having the room temperature. After the vacuum chamber is decompressed to 10–4 torr, the vacuum chamber is heated to 700° C. Pressure change in the vacuum chamber during heating is measured. An amount of thermal decomposition gas generated from the die release lubricant is estimated from the pressure change in the vacuum chamber.

On the other hand, conventional water soluble die release agent including refined mineral oil at 42.6% by weight, refined vegetable oil at 30.0% by weight and surface active agent at 17.4% by weight is prepared as a comparison. Each of the refined mineral oil, refined vegetable oil and surface active agent is dispersed into water. The above-mentioned measurement is also conducted against the comparison. The results are shown in FIG. 1.

Figure 1:
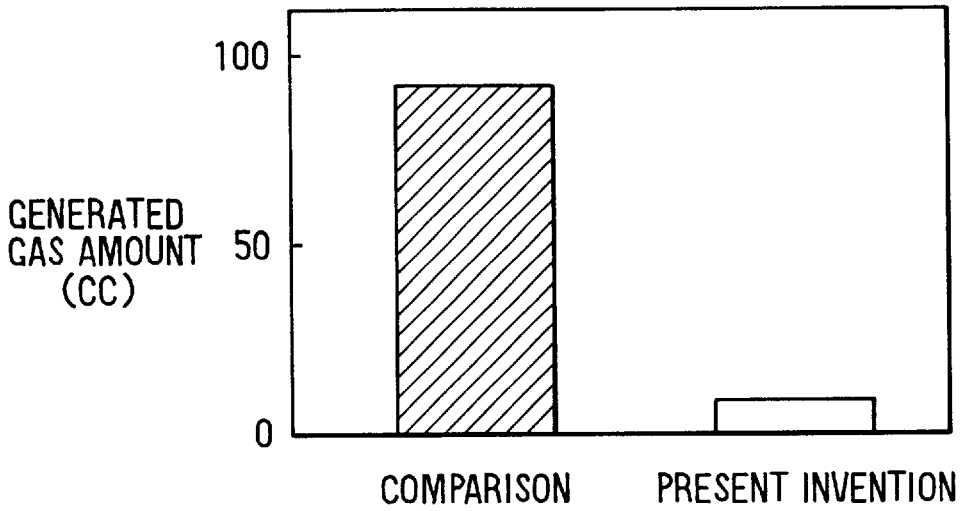
FIG. 1 is a map showing each amount of thermal decomposition gas generated by a conventional die release lubricant and a die release lubricant according to a preferred embodiment of the present invention.

As shown in FIG. 1, the die release lubricant according to the embodiment generates an extremely little amount of thermal decomposition gas in comparison with the conventional die release agent.

Figure 2:
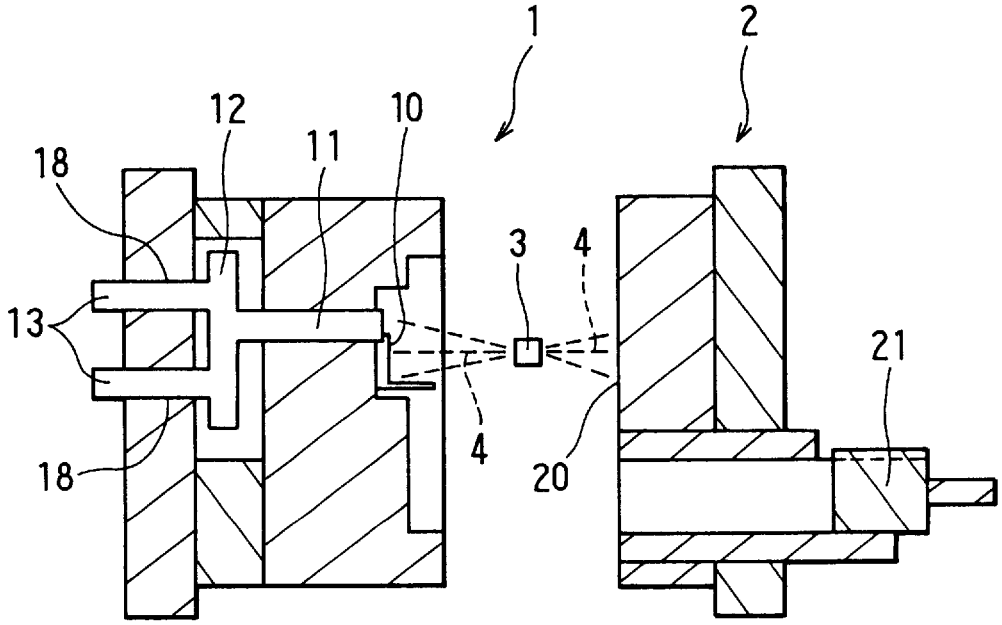
FIG. 2 is a schematic view showing a die applied with a die release lubricant according to the embodiment.

Next, each resistance against releasing molded metal from the die (hereinafter referred to as resistance to release) of the die release lubricant according to the embodiment and the conventional die release agent is measured under the same casting condition as for mass production, using a die for a part of a fuel injection pump. As shown in FIG. 2, the die includes a movable die 1 having an inside surface 10 and a static die 2 having an inside surface 20 and disposed to face the movable die 1. The movable die 1 has an pushing pin 11 for pushing out molded metal. The pushing pin 11 is disposed adjacent to the inside surface 10. A rod 13 is connected to the pushing pin 11 through an pushing plate 12. A distortion gauge 18 is attached to the rod 13 to measure force generated when the molded metal is released from the die. The resistance to release of the die release lubricant is estimated from the measured force. The static die 2 has a plunger 21 for pushing melted metal into the die. The die release lubricant is sprayed to the inside surfaces 10, 20 through a spray nozzle 3.

A method of measuring resistance to release of the die release lubricant will be described. First, the movable die 1 is separated from the static die 2, and a die release lubricant 4 according to the embodiment is sprayed to the inside surfaces 10, 20 through the spray nozzle 3. Next, the die is closed, and melted aluminum metal is pushed into the die by the plunger 21. After the die is sufficiently cooled, the die is opened. Then, the molded metal is pushed out from the die by the pushing pin 11 through the pushing plate 12 and the rod 13. A force generated when the molded metal is released from the die is measured through the distortion gauge 18, and resistance to release of the die release lubricant 4 is estimated from the measured force.

Conventional die release agent made of refined mineral oil and vegetable oil is diluted by 100 times with water and is used as a comparison to the die release lubricant 4. Resistance to release of the comparison is also measured through the above-mentioned method. The results are shown in FIG. 3.

Figure 3:
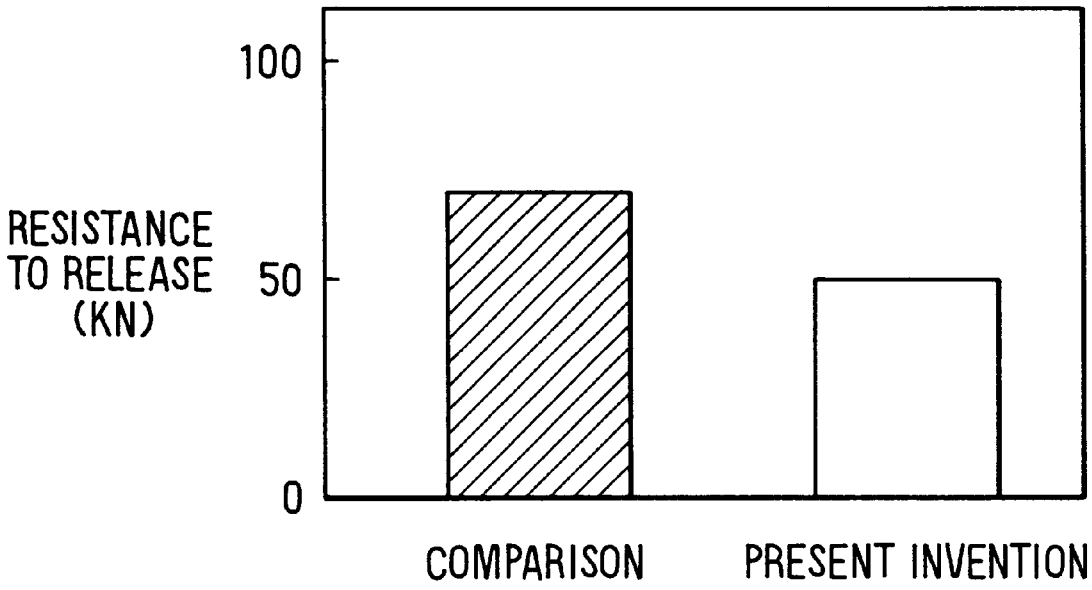
FIG. 3 is a map showing each resistance to release of a conventional die release lubricant and the die release lubricant according to the embodiment.

As shown in FIG. 3, the resistance to release of the die release lubricant according to the embodiment is 50 KN while that of the comparison is 70 KN. Therefore, the die release lubricant according to the embodiment has relatively high releasability.

According to the embodiment of the present invention, the die release lubricant is in a liquid state and is made from powder solid lubricant, adhesion enhancer made of organic or inorganic compound and volatile solvent. The adhesion enhancer is dissolved into the volatile solvent, and the powder solid lubricant is dispersed into the volatile solvent including the adhesion enhancer. The powder solid lubricant has an extremely small average particle radius such as 10 $\mu$m or smaller, and is uniformly dispersed in the die release lubricant. Therefore, when the die release lubricant is applied to the inside surface of the die through a spray nozzle or the like, the volatile solvent is immediately volatized, thereby making the powder solid lubricant quickly and firmly adhere to the inside surface of the die with the adhesion enhancer. Further, since the die release lubricant is sprayed in a liquid state, the die release lubricant is less scattered due to air flowing around the die in comparison with conventional powder die release agent. As a result, application efficiency and a working environment are improved.

Further, since the die release lubricant is in a liquid state, even when the die release lubricant is applied to a part of the inside surface of the die, the die release lubricant spreads quickly. Therefore, uniform application of the die release lubricant to the die is readily achieved.

Furthermore, in the die release lubricant, the adhesion enhancer is dissolved in the volatile solvent, and the powder solid lubricant is dispersed into the volatile solvent including the adhesion enhancer. Therefore, the powder solid lubricant, which is a main composition of the die release lubricant, is applied to the inside surface of the die with excellent uniformity.

Further, since the adhesion enhancer is made of organic or inorganic compound, adhesion strength of the powder solid lubricant to the die is relatively large. Therefore, an application amount of the die release lubricant is decreased in comparison with conventional die release agent. As a result, an amount of thermal decomposition gas generated during casting is decreased, and quality of the molded metal is improved.

Further, the die release lubricant includes the volatile solvent. Therefore, the die release lubricant is readily applied to the inside surface of the die, and the volatile solvent is immediately volatized when the die release lubricant is applied to the die. As a result, the powder solid lubricant is quickly and firmly adhered to the inside surface of the die with the adhesion enhancer.

Thus, the die release lubricant according to the embodiment is uniformly applied to the inside surface of the die and generates little amount of thermal decomposition gas, while improving application efficiency and the working environment.

The powder solid lubricant has an average particle radius of 0.1–10 $\mu$m and includes particles having a radius of smaller than 0.1 $\mu$m at less than 5% by weight, and particles having a radius of larger than 10 $\mu$m at less than 5% by weight. In this case, uniformity of application of the die release lubricant to the die is further improved.

When the powder solid lubricant has an average particle radius of smaller than 0.1 μm or includes particles having a radius of smaller than 0.1 μm at 5% or more by weight, a specific surface area of the powder solid lubricant is increased, thereby causing shortage of the adhesion-enhancer. As a result, adhesion strength of the die release lubricant is decreased, and a lubricant film is not formed uniformly, thereby worsening lubricity and releasability of the die release lubricant. Further, an amount of gas absorbed to the powder solid lubricant increases due to increase in the specific surface area of the powder solid lubricant, thereby increasing an amount of thermal decomposition gas generated during casting.

On the other hand, when the powder solid lubricant has an average particle radius of larger than 10 μm, or includes particles having a radius of larger than 10 μm at 5% or more by weight, the die release lubricant tends to be precipitated and accumulated in a pipe through which the die release lubricant is supplied to the die. As a result, the pipe is clogged and the die release lubricant is not smoothly sprayed. Therefore, a lubricant film is formed incompletely, and lubricity and releasability of the die release lubricant is worsened.

A weight ratio of the adhesion enhancer to the powder solid lubricant is in a range of 0.05/100 and 15/100 so that adhesion strength of the die release lubricant is improved.

When the weight ratio of the adhesion enhancer to the powder solid lubricant is less than 0.05/100, adhesion strength of the powder solid lubricant is decreased and a lubricant film is not formed uniformly. As a result, lubricity and releasability of the die release lubricant is worsened. On the other hand, when the weight ratio of the adhesion enhancer to the powder solid lubricant is more than 15/100, an amount of thermal decomposition gas generated during casting is increased, while adhesion strength of the die release lubricant is not so increased.

The volatile solvent has a boiling point of 40–150° C. and a firing point of 250° C. or over. In this case, the volatile solvent is immediately volatized when the die release lubricant is applied to the die, and the powder solid lubricant is quickly and firmly adhered to the inside surface of the die with the adhesion enhancer.

When the volatile solvent has a boiling point of 40° C. or lower, the die release lubricant tends to be volatized during production, storage and casting processes. As a result, handling of the die release lubricant becomes difficult and concentration of the diluted die release lubricant becomes uneven. When the boiling point of the volatile solvent is 150° C. or higher, the die release lubricant is slow to be dried and the volatile solvent remains on the surface of the die. As a result, an amount of thermal decomposition gas generated during casting is increased. When the firing point is 250° C. or lower, the die release lubricant may catch fire when sprayed to the die.

The volatile solvent is at least one selected from a group consisting of toluene, xylene, methylene chloride, amyl chloride, butyl stearate, isopropyl acetate, methyl propyl ketone, methyl isobutyl ketone, epichlorohydrine, dioxane, cellosolve, acetate, methyl cellosolve, isopropyl alcohol, ethanol, methanol, chlorofluorocarbon group solvent and mixed solvent of any one of the above-mentioned solvents and water.

In this case, volatility of the volatile solvent is increased when the die release lubricant is applied to the inside surface of the die, and dispersibility of the powder solid lubricant in the die release lubricant is increased. Particularly, an amount of thermal decomposition gas generated during casting is drastically decreased due to the excellent volatility of the volatile solvent.

The powder solid lubricant is at least one selected from a group consisting of boron nitride, mica, talc, graphite, molybdenum disulfide, graphite fluoride, tungsten disulfide, metallic oxide, soft metal, polytetrafluoroethylene (Teflon), melamine cyanurate resin (MCA), silicon resin, frit, oxide glass, aromatic dicarboxylic acid, carbon black, kaoline and bentonite. In this case, the present invention is effectively applied.

The adhesion enhancer is at least one selected from a group consisting of polyester resin, amino resin, vinyl resin, urethane resin, acrylic resin, epoxy resin, cellulose resin, phenol aldehyde resin, polyimide resin, silicon resin, fluorine contained resin, polyethylene resin, hydrocarbon resin, starch, casein, gelatin, cellulose, carboxymethyl cellulose (CMC), polyvinyl alcohol (PVA), polyvinyl pyrrolidone (PVP), surface active agent, natural rubber, synthetic rubber, wax, sodium silicate, sodium borate, colloidal silica, colloidal alumina, metallic soap, carboxylic acid, glycol, acrylic acid and coupling agent. In this case, the present invention is effectively applied.

The die release lubricant includes the powder solid lubricant at 1–70% by weight, the adhesion enhancer at 0.0005–10.5% by weight and the volatile solvent at 98.995–19.5% by weight when it is used. In this case, productivity of the die release lubricant is improved.

When the die release lubricant includes the powder solid lubricant at less than 1% by weight, transportation cost of the die release lubricant is increased. On the other hand, when the die release lubricant includes the powder solid lubricant at more than 70% by weight, each composition of the die release lubricant may not be dispersed uniformly in the die release lubricant.

When the die release lubricant includes the adhesion enhancer at less than 0.0005% by weight, the powder solid lubricant is insufficiently adhered to the die, and a lubricant film may not be formed uniformly. As a result, lubricity and releasability of the die release lubricant is worsened. On the other hand, when the die release lubricant includes the adhesion enhancer at more than 10.5% by weight, the amount of thermal decomposition gas generated during casting is increased, while adhesion strength of the die release lubricant is not so increased.

Particularly, when the die release lubricant includes the powder solid lubricant at 0.1–20% by weight, the adhesion enhancer at 0.00005–3% by weight and the volatile solvent at 98.99995–77% by weight, the die release lubricant is more uniformly applied to the die and generates an extremely little amount of thermal decomposition gas.

When the die release lubricant includes the powder solid lubricant at less than 0.1% by weight, lubricity and releasability of the die release lubricant is worsened. On the other hand, when the die release lubricant includes the powder solid lubricant at more than 20% by weight, the die release lubricant is not uniformly applied to the die.

When the die release lubricant includes the adhesion enhancer at less than 0.00005% by weight, the powder solid lubricant is insufficiently adhered to the die, and an uniform lubricant film is not be formed. As a result, lubricity and releasability of the die release lubricant is worsened. On the other hand, when the die release lubricant includes the adhesion enhancer at more than 3% by weight, the amount of thermal decomposition gas generated during casting is increased, while adhesion strength of the die release lubricant is not so increased.

Next, a part of a fuel injection pump is molded from ADC 12 alloy using the die release lubricant according to the embodiment of the present invention.

First, the die release lubricant is sprayed to the inside surfaces 10, 20 of the die in FIG. 2. Then, the die is closed, and the melted ADC 12 alloy is pushed into the die by the plunger 21. The die release lubricant is made of boron nitride as-powder solid lubricant at 2% by weight, vinyl resin as adhesion enhancer at 0.1% by weight and mixed solvent as volatile solvent at 97.9% by weight, and is in a liquid state. The mixed solvent consists of ethyl alcohol, methanol and isopropyl alcohol.

The powder solid lubricant has an average particle radius of 2 $\mu$m, and includes particles having a radius smaller than 0.1 $\mu$m at 1.0% by weight and particles having a radius larger than 10 $\mu$m at 0.5% by weight. The volatile solvent has a boiling point of 68° C. and a firing point of 390° C. Pressure applied to the melted ADC 12 alloy during casting is equivalent to approximately 800 kg/cm$^2$ of cast metal pressure.

The molded part has excellent quality and no defects such as the shrinkage cavity and wrinkling. Further, resistance to release of the die release lubricant is relatively low as 50 KN. Furthermore, the die release lubricant is uniformly applied to the inside surface of the die.

The present invention is suitably applied to casting of non-iron metal such as aluminum, magnesium, zinc and copper.

The compositions of the die release lubricant in the present invention are preliminarily mixed in an appropriate container, and then are fully mixed in an appropriate mixer such as a ball mill.

Although the present invention has been fully described in connection with a preferred embodiment thereof with reference to the accompanying drawings, it is to be noted that various changes and modifications will become apparent to those skilled in the art.

Such changes and modifications are to be understood as being within the scope of the present invention as defined by the appended claims.

What is claimed is:

1. A die release lubricant comprising:

powder solid lubricant;

adhesion enhancer made of either one of organic and inorganic compounds for increasing adhesion strength of said powder solid lubricant onto an inside surface of a die; and volatile solvent for keeping said die release lubricant in a liquid state when applied onto said inside surface, said volatile solvent being immediately volatized after being applied onto said inside surface.

2. The die release lubricant according to claim 1, wherein;

said powder solid lubricant has an average particle radius of 0.1–10 $\mu$m;

said powder solid lubricant includes particles having a radius of smaller than 0.1 $\mu$m at less than 5% by weight and particles having a radius of larger than 10 $\mu$m at less than 5% by weight.

3. The die release lubricant according to claim 1, wherein a weight ratio of said adhesion enhancer to said powder solid lubricant is in a range of 0.05/100 and 15/100.

4. The die release lubricant according to claim 1, wherein said volatile solvent has a boiling point of 40–150° C. and a firing point of 250° C. or higher.

5. The die release lubricant according to claim 1, wherein said volatile solvent is at least one selected from a group consisting of toluene, xylene, methylene chloride, amyl chloride, butyl stearate, isopropyl acetate, methyl propyl ketone, methyl isobutyl ketone, epichlorohydrine, dioxane, cellosolve acetate, methyl cellosolve, isopropyl alcohol, ethanol, methanol, chlorofluorocarbon group solvent and mixed solvent of any one of the above-mentioned solvents and water.

6. The die release lubricant according to claim 1, wherein said powder solid lubricant is at least one selected from a group consisting of boron nitride, mica, talc, graphite, molybdenum disulfide, graphite fluoride, tungsten disulfide, metallic oxide, soft metal, polytetrafluoroethylene (Teflon), melamine cyanurate resin (MCA), silicon resin, frit, oxide glass, aromatic dicarboxylic acid, carbon black, kaoline and bentonite.

7. The die release lubricant according to claim 1, wherein said either one of organic and inorganic compounds is at least one selected from a group consisting of polyester resin, amino resin, vinyl resin, urethane resin, acrylic resin, epoxy resin, cellulose resin, phenol aldehyde resin, polyimide resin, silicon resin, fluorine contained resin, polyethylene resin, hydrocarbon resin, starch, casein, gelatin, cellulose, carboxymethyl cellulose (CMC), polyvinyl alcohol (PVA), polyvinyl pyrrolidone (PVP), surface active agent, natural rubber, synthetic rubber, wax, sodium silicate, sodium borate, colloidal silica, colloidal alumina, metallic soap, carboxylic acid, glycol, acrylic acid and coupling agent.

8. The die release lubricant according to claim 1, wherein said die release lubricant includes said powder solid lubricant at 1–70% by weight, said adhesion enhancer at 0.0005–10.5% by weight and said volatile solvent at 98.995–19.5% by weight.

9. The die release lubricant according to claim 1, wherein said die release lubricant includes said powder solid lubricant at 0.1–20% by weight, said adhesion enhancer at 0.00005–3% by weight and said volatile solvent at 98.99995–77% by weight.

10. The die release lubricant according to claim 1, wherein:

said powder solid lubricant is graphite;

said adhesion enhancer is hydrocarbon resin;

said volatile solvent is alternate chlorofluorocarbon group solvent; and said die release lubricant includes said powder solid lubricant at 2% by weight, said adhesion enhancer at 0.2% by weight and said volatile solvent at 97.8% by weight.

11. A die release lubricant comprising:

powder solid lubricant;

adhesion enhancer for increasing adhesion strength of said powder solid lubricant; and volatile solvent other than water, having a boiling point of 40–150° C. and a firing point of 250° C. or higher.

12. The die release lubricant according to claim 11, wherein:

said volatile solvent is at least one selected from a group consisting of toluene, xylene, methylene chloride, amyl chloride, butyl stearate, isopropyl acetate, methyl propyl ketone, methyl isobutyl ketone, epichlorohydrine, dioxane, cellosolve acetate, methyl cellosolve, isopropyl alchol, ethanol, methanol, and chlorofluorocarbon group solvent.

13. The die release lubricant according to claim 11, further comprising water mixed with said volatile solvent.

* * * * *